United States Patent [19]

Francis

[11] Patent Number: 4,932,123

[45] Date of Patent: Jun. 12, 1990

[54] IMPROVEMENTS IN OR RELATING TO SAFETY RAZORS

[75] Inventor: John F. Francis, Surrey, England

[73] Assignee: The Gillette Company, Boston, Mass.

[21] Appl. No.: 299,964

[22] PCT Filed: Apr. 18, 1988

[86] PCT No.: PCT/US88/01343

§ 371 Date: Dec. 28, 1988

§ 102(e) Date: Dec. 28, 1988

[87] PCT Pub. No.: WO88/08776

PCT Pub. Date: Nov. 17, 1988

[30] Foreign Application Priority Data

May 8, 1987 [GB] United Kingdom ..... 8710963

[51] Int. Cl.[5] ..... B26B 21/00; B26B 21/08; B26B 21/12; B26B 21/14

[52] U.S. Cl. ..... 30/77; 30/47; 30/50; 30/57

[58] Field of Search ..... 30/47, 50, 57, 70, 72, 30/73, 77, 83, 89, 346, 58

[56] References Cited

U.S. PATENT DOCUMENTS

| | | |
|---|---|---|
| 3,909,941 | 10/1975 | Bowman et al. . |
| 3,909,942 | 10/1975 | Ciaffone . |
| 4,063,354 | 12/1977 | Oldroyd et al. . |
| 4,270,268 | 6/1981 | Jacobson . |
| 4,378,633 | 4/1983 | Jacobson . |
| 4,403,412 | 9/1983 | Trotta . |
| 4,501,067 | 2/1985 | Duncan . |
| 4,516,321 | 5/1985 | Francis . |
| 4,586,255 | 5/1986 | Jacobson . |

*Primary Examiner*—Douglas D. Watts
*Assistant Examiner*—Paul M. Heyrana, Sr.
*Attorney, Agent, or Firm*—Ladas & Parry

[57] ABSTRACT

A razor formed as a unitary moulding comprises a main body 1 including a cap member 3 and two side walls 4 and a guard member 6 connected to the body 1 by spring fingers 7 and living hinges which permit the guard member to be located in guide means 9 which guide the guard member for limited displacement during shaving.

3 Claims, 2 Drawing Sheets

IMPROVEMENTS IN OR RELATING TO SAFETY RAZORS

This invention relates to safety razors, and in particular to razor heads, or cartridges, having guard members which are resiliently displaceable in reaction to the forces encountered during shaving.

Razor heads or cartridges of this form are described, for example, in British Patent Specifications 1566505, 2131337 and 2064410.

The present invention is particularly concerned with the construction of a cartridge body which permits of its being formed as a unitary plastics moulding incorporating the guard member and spring means for its resilient mounting relative to the main body of the cartridge.

In the cartridge described below, the guard member, in the form of an elongate bar, is integrally connected to the rest of the body by resilient fingers incorporating living hinges permitting the bar to be displaced from its original moulded position into engagement with guide means in the body, so that the bar is resiliently displaceable relative to the rest of the body in use of the cartridge.

This cartridge will now be described in detail, by way of example, with reference to the accompanying drawings, in which.

Figure 1:
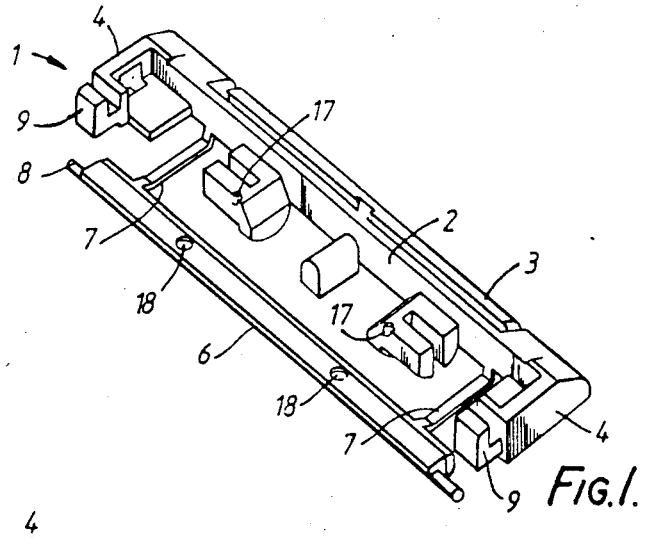
FIG. 1 is a perspective view of the cartridge body "as moulded"

FIG. 1 shows the integrally moulded cartridge body 1 in its condition "as moulded". It comprises: a rear wall 2, whose upper surface 3 is destined to form a cap to the rear of the blades; opposite side walls 4; and a guard bar 6 integrally connected to the rear wall by spring fingers 7. The ends of the bar 6 are provided with projecting pins 8 for eventual location in guide brackets 9 at the forward ends of the side walls 4.

Figure 2:
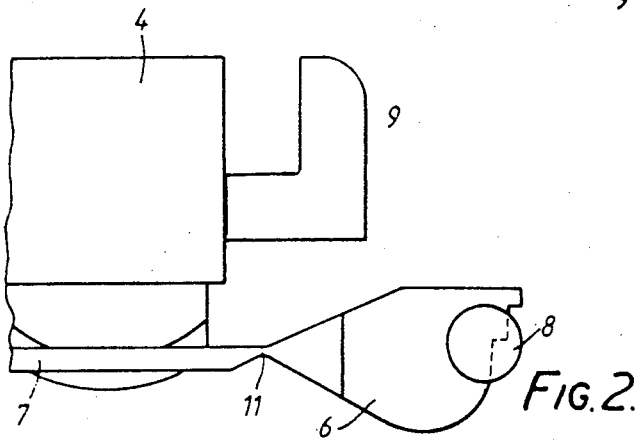
FIGS. 2 and 3 are end views showing the guard bar in its moulded and its assembled positions, respectively.
Figure 3:
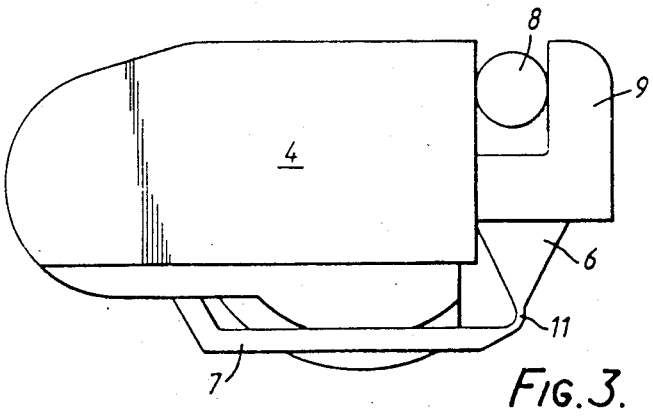

As best seen in FIGS. 2 and 3, the junctions between the free ends of fingers 7 and the guard bar 6 are of reduced cross-section to form living hinges 11. After molding, the guard bar is swung upwardly, in an anticlockwise direction (as viewed in FIGS. 2 and 3), to bring the pins 8 up and over the brackets 9, with some resilient deflection of the spring fingers 7, to assume the assembled position seen in FIG. 3, in which the pins are guided for movement relative to the rest of the cartridge body in a vertical direction, assuming the cartridge to be in a horizontal attitude.

Figure 4:
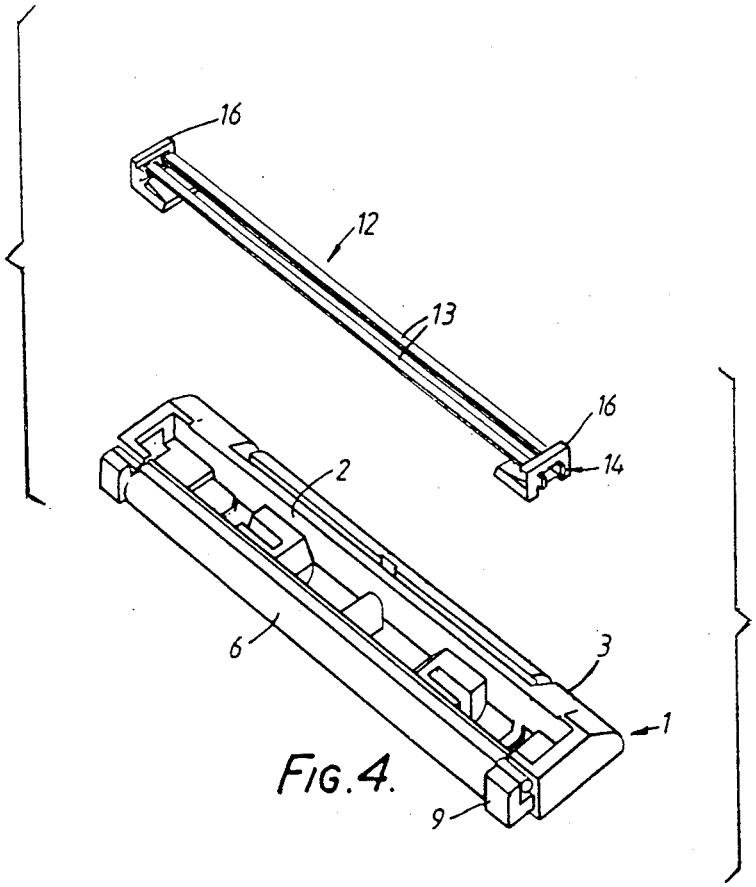
FIG. 4 is an exploded perspective view of the completed cartridge body and a tandem blade unit for mounting therein.

As illustrated in FIG. 4, the cartridge body now forms a generally rectangular open frame for reception and location of a blade unit 12, formed in this example by a pair of narrow blade strips 13 each secured to wire like supports 14 held in spaced parallel relation by end clips 16. These clips are secured with the cartridge and provide for resilient mounting of the blades which are independently sprung so as to be urged upwardly but displaceable downwardly in response to forces encountered during shaving.

Figure 5:
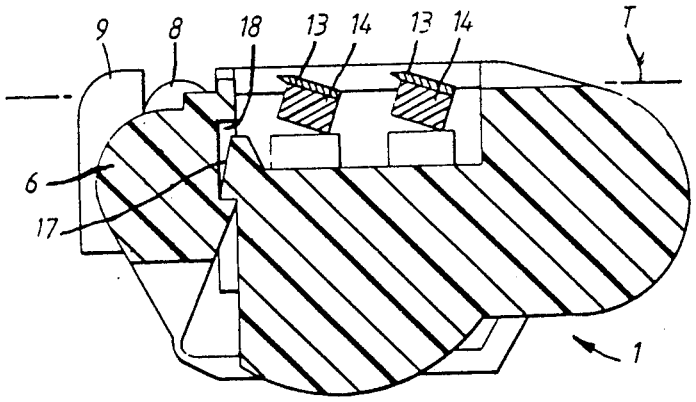
FIG. 5 is a cross-section of the assembled cartridge.

FIG. 5 shows a cross-section of the assembled cartridge and a notional tangent plane T containing the upper surfaces of the guard bar in a medial position and cap. In use of the cartridge, each of the blades and guard bar are resiliently displaceable downwardly in directions perpendicular to the tangent plane T in response to forces encountered during shaving.

As best seen in FIG. 5, upward movement of the guard bar 6 is limited by the interengagement of projections 17 at the front of the body 1 in circular recesses 18 formed in the inner surface of the bar 6.

It will be understood that the term vertically and horizontally are employed herein for the purposes of description and that the cartridge will adopt many different attitudes in use.

I claim:

1. A razor head comprising a main body having location means for receiving elongate blade means and a guard member which is resiliently displaceable in reaction to forces encountered during shaving, the said main body and guard member being formed as a unitary plastics moulding in which the guard member is connected to the main body by resilient fingers and living hinges which together permit the guard member to be displaced relative to the main body from an original position as moulded, into engagement with guide means on the main body, the said guide means permitting displacement of the guard member against the restoring action of the resilient fingers.

2. A razor head according to claim 1, wherein the main body comprises a rear wall having a skin-engaging cap surface and forwardly projecting, opposite side walls, the said fingers projecting forwardly from the rear wall and being connected to the said guard member by living hinges, and wherein the said guide means are formed at the forward ends of the said side walls to define guide slots open from above, the guard members being engageable in the said slots by flexure of the said fingers and of the said hinges.

3. A razor head according to claim 2, wherein the main body and guard member are formed with cooperating abutment means which are interengaged when the guard member is engaged in the guide means, the said abutment means serving to limit displacement of the guard member relative to the guide means.

* * * * *